US006935910B2

(12) United States Patent
Laine

(10) Patent No.: US 6,935,910 B2
(45) Date of Patent: Aug. 30, 2005

(54) WATERSPORT BOARD FIN ASSEMBLY AND METHODS OF USING SAME

(76) Inventor: John Laine, 4820 O'Hara Dr., Evansville, IN (US) 47711

( * ) Notice: Subject to any disclaimer, the term of this patent is extended or adjusted under 35 U.S.C. 154(b) by 0 days.

(21) Appl. No.: 10/661,112

(22) Filed: Sep. 12, 2003

(65) Prior Publication Data

US 2005/0059304 A1 Mar. 17, 2005

(51) Int. Cl.[7] ..... B63B 1/00
(52) U.S. Cl. ..... 441/79; 114/127; 114/140
(58) Field of Search ..... 441/65, 74, 79; 114/140, 127

(56) References Cited

U.S. PATENT DOCUMENTS

| | | | | |
|---|---|---|---|---|
| 4,044,416 A | | 8/1977 | Brewer et al. | |
| 4,325,154 A | | 4/1982 | Collum, Jr. | |
| 4,421,492 A | | 12/1983 | Leva | |
| 4,441,446 A | | 4/1984 | Fichtner | |
| 4,805,546 A | | 2/1989 | Geller et al. | |
| 4,883,436 A | | 11/1989 | Oakland | |
| 5,069,406 A | | 12/1991 | Colyer et al. | |
| 5,148,761 A | | 9/1992 | Winner | |
| 5,328,397 A | | 7/1994 | Whitty | |
| 5,351,638 A | * | 10/1994 | Helleberg | 114/140 |
| 5,480,331 A | | 1/1996 | Lewis | |
| 5,487,351 A | * | 1/1996 | Nedderman, Jr. | 114/332 |
| 5,934,963 A | | 8/1999 | Frizzell | |
| 5,951,347 A | | 9/1999 | Hudson et al. | |
| 5,975,974 A | | 11/1999 | McCausland | |
| 6,053,789 A | * | 4/2000 | Miyashiro | 441/79 |
| 6,106,347 A | | 8/2000 | Harness | |
| 6,135,837 A | | 10/2000 | Giles | |
| 6,139,383 A | | 10/2000 | Jolly et al. | |
| 6,149,479 A | * | 11/2000 | Redmon et al. | 441/79 |
| 6,254,649 B1 | | 7/2001 | Sherman et al. | |
| 6,257,941 B1 | | 7/2001 | Rhynsburger | |
| 6,305,305 B1 | | 10/2001 | Johnson | |
| 6,386,933 B1 | | 5/2002 | Rewald et al. | |
| 6,394,865 B1 | | 5/2002 | Arzadon | |

* cited by examiner

*Primary Examiner*—Stephen Avila
(74) *Attorney, Agent, or Firm*—Woodard, Emhardt, Moriarty, McNett & Henry LLP

(57) ABSTRACT

Fin assemblies for a variety of watersport boards including wakeboards, sailboards, surfboards and the like. The fin assemblies include a fin cap, at least one fin base and at least one locking member. Fin assemblies are secured to a watersport board by passing at least one locking member through channels in the board and fin base and into sockets in the fin cap. Fin assemblies are reconfigured by first removing the locking members, arranging the desired combination of fin cap and fin base suitable for current water conditions and/or user ability and then resecuring the fin assembly to the board with locking members.

20 Claims, 10 Drawing Sheets

WATERSPORT BOARD FIN ASSEMBLY AND METHODS OF USING SAME

FIELD OF THE INVENTION

The present invention relates generally to a fin assembly for a watersport board and more particularly to a fin assembly which is detachable from a watersport board.

BACKGROUND OF THE INVENTION

Watersport boards such as wake boards, windsurfing boards, surfboards and the like include one or more fins configured to improve the stability and/or maneuverability of the board. A longer and wider fin increases the stability of the board but decreases the maximum speed of the board because of increased drag. Additionally, the optimal fin size and configuration varies according to the type, size and condition of the waves on a particular body of water.

Traditionally, fins are permanently attached to a watersport board. This design forces the user to own and transport multiple boards having different fin configurations so as to be able to take advantage of the optimal configurations for the current water conditions at a particular body of water. Permanently mounted fins also forces users to upgrade boards as their skills improve. For example, a board for a beginner may have a fin configuration designed to maximize board stability while a board for a more advanced user may have a fin configuration designed to maximize the speed and maneuverability of the board. Having to own multiple boards designed for different water conditions and having to upgrade boards multiple times as a user's abilities improve is inconvenient and expensive.

In view of the foregoing, there is a need for customizable fin assemblies for watersport boards which eliminate the need for multiple boards suited to particular water conditions and/or user ability levels.

SUMMARY OF INVENTION

The invention is set forth in the claims below, and the following is not in any way to limit, define or otherwise establish the scope of legal protection. In general terms, the present invention relates to a customizable fin assembly for a watersport board, as well as associated methods. More particularly, the present invention relates to a fin assembly for a watersport board comprising a fin cap, a fin base and one or more locking members. According to one embodiment of the present invention, a fin cap is mounted to a fin base and the fin base is mounted to a watersport board. The fin cap, fin base and watersport board are locked together using one or more locking members.

Further objects, embodiments, forms, benefits, aspects, features and advantages of the present invention may be obtained from the description, drawings, and claims provided herein.

DESCRIPTION OF THE PREFERRED EMBODIMENTS

Figure 1:
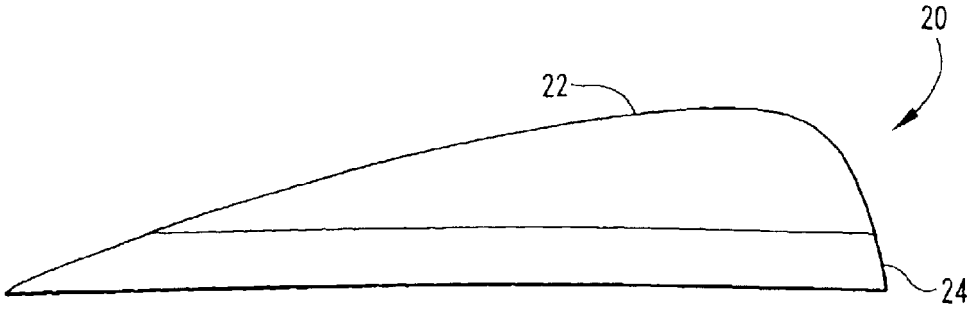
FIG. 1 is a side view of a fin assembly according to one embodiment of the present invention.

For the purposes of promoting understanding of the principles of the invention, reference will now be made to the embodiments illustrated in the drawings and specific language will be used to describe the same. It will nevertheless be understood that no limitation of the scope of the invention is hereby intended and alterations and modifications in the illustrated device, and further applications of the principles of the present invention as illustrated herein being contemplated as would normally occur to one skilled in the art to which the invention relates.

Figure 2:
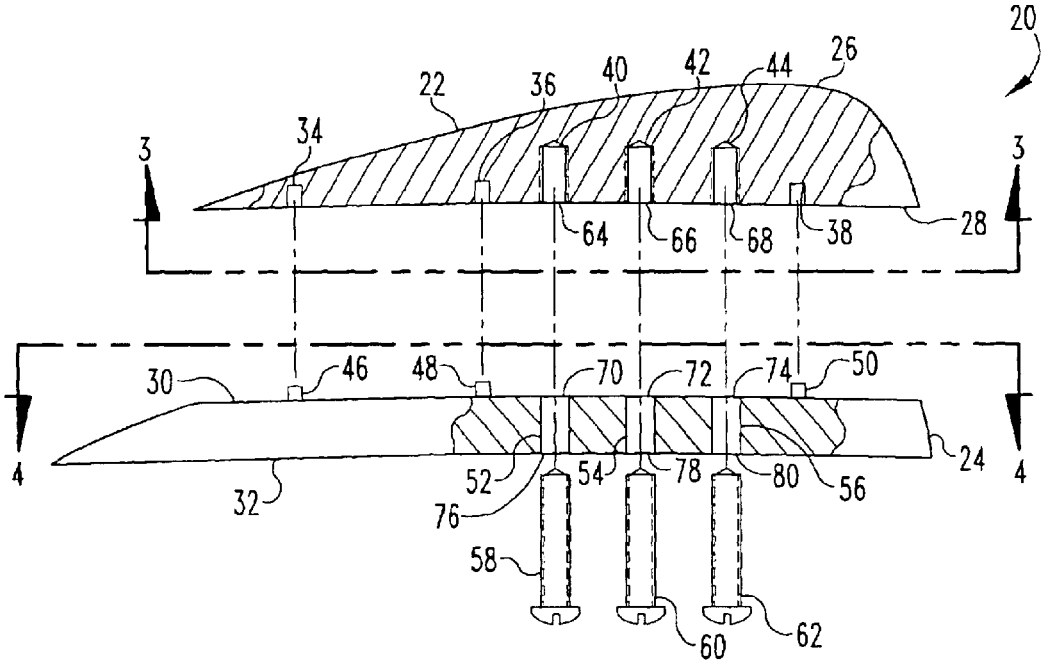
FIG. 2 is an exploded, partial cross-sectional view of the fin assembly shown in FIG. 1.

A fin assembly 20 according to one embodiment of the present invention is shown in FIG. 1. In this particular example, fin assembly 20 comprises a fin cap 22, a fin base 24 and at lest one locking member 58, 60, 62 (FIG. 2). In alternative embodiments of the present invention (not shown), a fin assembly includes at least one fin base, a fin cap and at least one locking member. An exploded, partial cross-sectional view of fin assembly 20 is shown in FIG. 2. In this particular embodiment, fin cap 22 includes a tip portion 26, a mounting surface 28 and two opposed major surfaces 82 and 84 (FIG. 3) extending between tip 26 and mounting surface 28. Fin base 24 includes a first mounting surface 30, a second mounting surface 32 and two opposed major surfaces 86 and 88 (FIG. 4) extending between first mounting surface 30 and second mounting surface 32.

Continuing with the present example, fin cap 22 further includes at least one mounting socket 40, 42, 44. In this particular example, three mounting sockets 40, 42, 44 are shown for illustrative purposes only and fin caps having a different number of mounting sockets are also contemplated. Each mounting socket 40, 42, 44 includes a mounting socket opening 64, 66 and 68 in mounting surface 28 and a locking mechanism (not shown) corresponding to locking members 58, 60 and 62 as will be described in greater detail below. Preferably, fin cap 22 further includes one or more guide pin sockets 34, 36 and 38. In this particular example, fin cap 22 is shown with three guide pin sockets 34, 36 and 38 although fin caps having more, fewer or no guide pin sockets are also contemplated.

Fin base 24 includes at least one mounting channel 52, 54, 56 passing therethrough. In this particular example, fin base 24 is shown with three mounting channels 52, 54, 56 although fin bases having more or fewer mounting channels are also contemplated. Preferably, fin base 24 has a mounting channel 52, 54, 56 corresponding to each mounting socket 40, 42, 44, respectively, of fin cap 22. Each mounting channel 52, 54, 56 includes a mounting channel opening 70, 72, 74 in first mounting surface 30 and a mounting channel opening 76, 78, 80 in second mounting surface 32. Preferably, fin base 24 further includes one or more guide pins 46, 48, 50 extending from first mounting surface 30. In this example, fin base 24 is shown with three guide pins 46, 48, 50 although fin bases having more, fewer or no guide pins are also contemplated. Preferably, fin base 24 has a guide pin 46, 48, 50 corresponding to each guide pin socket 34, 36, 38, respectively, on fin cap 22 and each guide pin 46, 48, 50 is sized and configured to fit securely in corresponding guide pin socket 34, 36, 38.

Three locking members 58, 60, 62 are shown in this particular example, although fin assemblies including more or fewer locking members are also contemplated. Preferably, fin assembly 20 includes one locking member 58, 60, 62 corresponding to each mounting socket 40, 42, 44, respectively, of fin cap 22. Locking members 58, 60, 62 are shown in FIG. 2 as screws for illustrative purposes only. Other suitable locking members such as bolts, bayonet-type fasteners and the like are also contemplated. Preferably, mounting socket 40, 42, 44 includes a locking mechanism suitable for locking member 58, 60, 62. In this particular example, mounting sockets 40, 42, 44 further include threaded portions (not shown) sized and configured to allow locking members 58, 60, 62 to be threaded into locking engagement with mounting sockets 40, 42, 44. Also preferably, mounting channels 52, 54, 56 are sized and configured so as to allow at least a portion of locking members 58, 60, 62 to pass therethrough.

Figure 3:
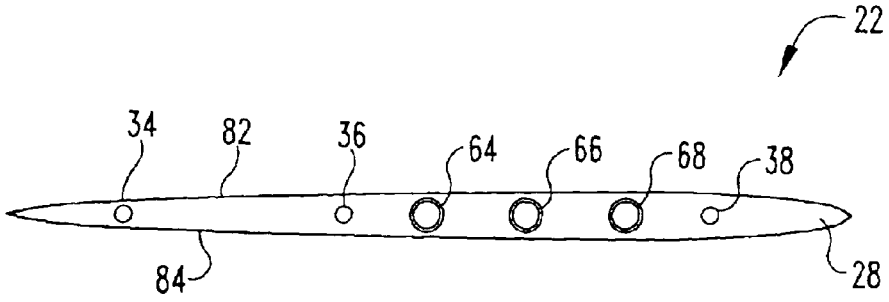
FIG. 3 is a bottom plan view of the fin assembly shown in FIG. 2 taken along line 3—3.
Figure 4:
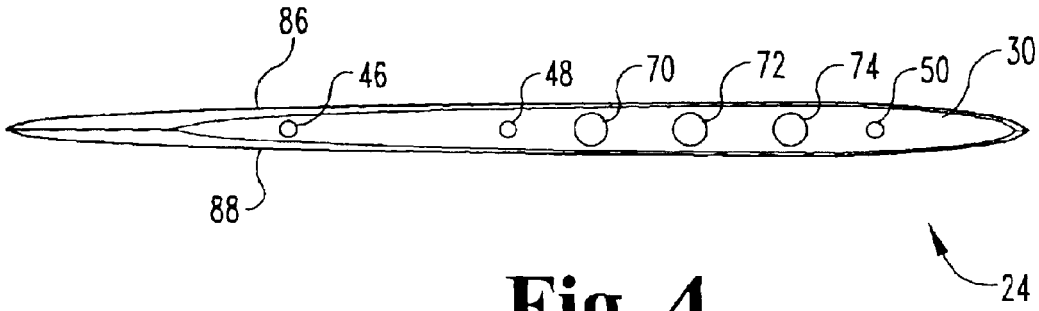
FIG. 4 is a top plan view of the fin assembly shown in FIG. 2 taken along line 4—4.

FIG. 3 is a bottom plan view of fin assembly 20 taken along line 3—3. In this example, guide pin sockets 34, 36, 38 and mounting socket openings 64, 66, 68 are arranged on mounting face 28 in a substantially linear configuration. In other examples of fin assemblies according to the present invention, the number, order and configuration of guide pin sockets and mounting sockets are substantially non-linear. FIG. 4 is a top plan view of fin assembly 20 taken along line 4—4. In this example, guide pins 46, 48, 50 and mounting channel openings 70, 72, 74 are arranged on first mounting surface 30 in a substantially linear configuration corresponding to the configuration of guide pin sockets 34, 36, 38 and mounting socket openings 64, 66, 68 on fin cap 22. In other examples of fin assemblies according to the present invention, the number and configuration of guide pins and mounting channel openings on the first mounting surface are substantially non-linear. Preferably, the arrangement of guide pins and mounting channel openings on a fin base corresponds to the arrangement of guide pin sockets and mounting socket openings on the fin cap. Surface 84 and surface 86 preferably form a continuous surface when mounting socket openings 64, 66, 68 and mounting channel openings 70, 72, 74 are aligned and mounting face 28 contacts first mounting surface 30. Additionally, Surface 82 and surface 88 preferably form a continuous surface when mounting socket openings 64, 66, 68 and mounting channel openings 70, 72, 74 are aligned and mounting face 28 contacts first mounting surface 30.

Figure 5:
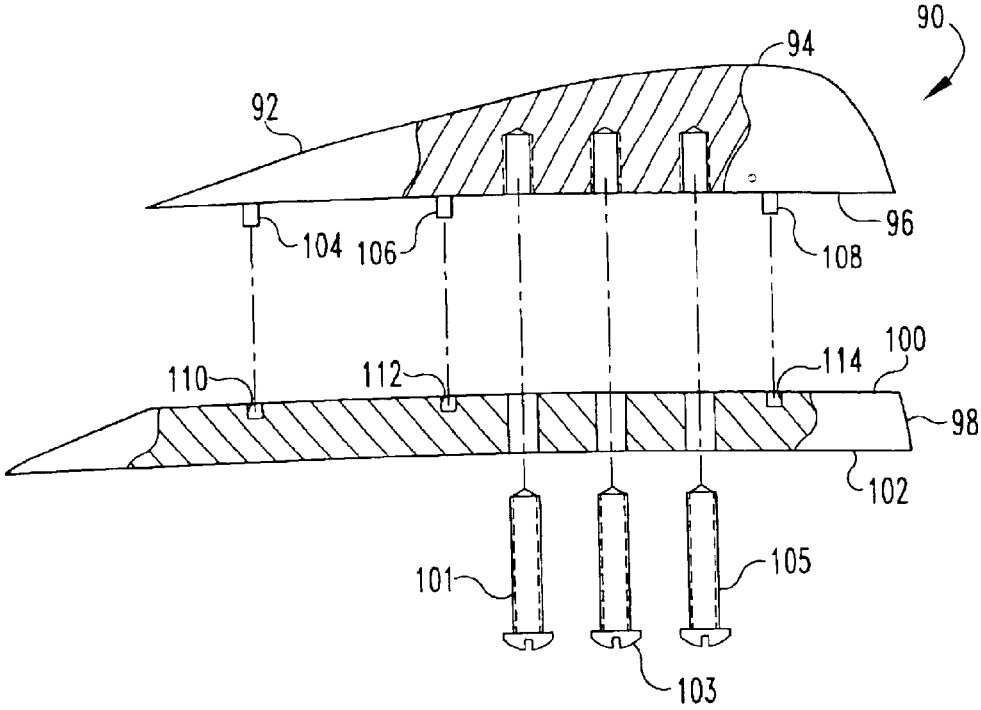
FIG. 5 is exploded, partial cross-sectional view of the fin assembly shown in FIG. 1 according to an alternative embodiment of the present invention.

FIG. 5 shows an exploded, partial cross-sectional view of a fin assembly 90 according to an alternative embodiment of the present invention. Fin assembly 90 comprises a fin cap 92 having a tip portion 94 and a mounting surface 96, a fin base 98 having a first mounting surface 100 and a second mounting surface 102, and a least one locking member 101, 103, 105. In this particular example, fin base 98 further includes at least one guide pin socket 110, 112, 114 in first mounting surface. Fin base 98 is shown with three guide pin sockets in this example, although fin bases having more, fewer or no guide pin sockets are also contemplated. Fin cap 92 further includes at least one guide pin 104, 106, 108 extending from mounting surface 96. Fin cap 92 is shown with three guide pins in this example, although fin caps having more, fewer or no guide pins are also contemplated. Preferably, fin cap 92 includes a guide pin 104, 106, 108 corresponding to each guide pin socket 110, 112, 114, respectively, on fin base 98 and each guide pin 104, 106, 108 is sized and configured to fit securely in the corresponding guide pin socket 110, 112, 114.

Figure 6:
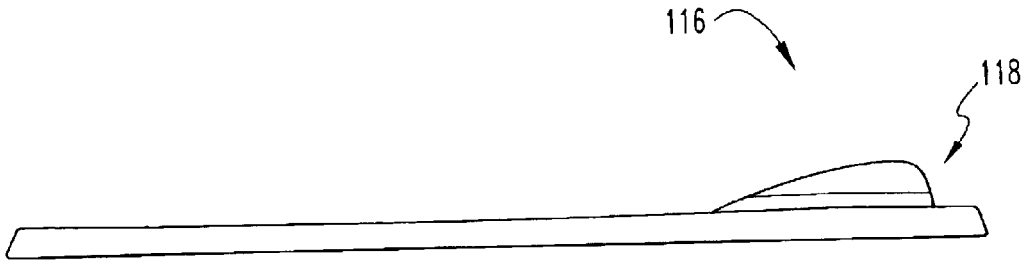
FIG. 6 is a side view of a wake board and fin assembly according to another embodiment of the present invention.
Figure 7:
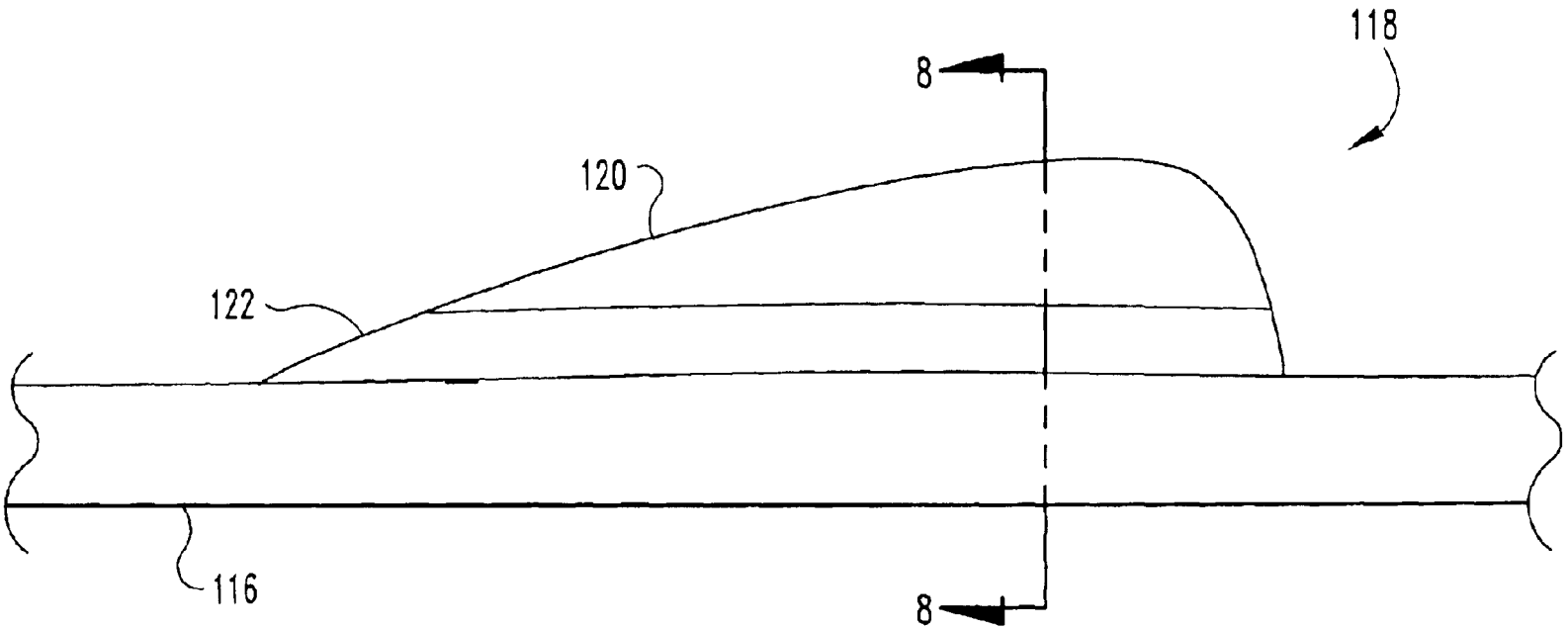
FIG. 7 is a detailed view of the wake board and fin assembly shown in FIG. 6.

FIG. 6 shows a watersport board 116 engaged with a fin assembly 118 according to another embodiment of the present invention. Watersport board 116 is shown as a wakeboard in this particular example although other examples of fin assemblies according to the present invention are used with other types of watersport boards and similar types of watercraft such as surfboards, windsurfing boards, waterskis, bodyboards, sailing craft and the like. FIG. 7 is a detailed view of wake board 116. Fin assembly 118 comprises a fin cap 120, and a fin base 122. In this particular view, bootstraps normally used with wakeboards have been removed for the sake of clarity.

Figure 8:
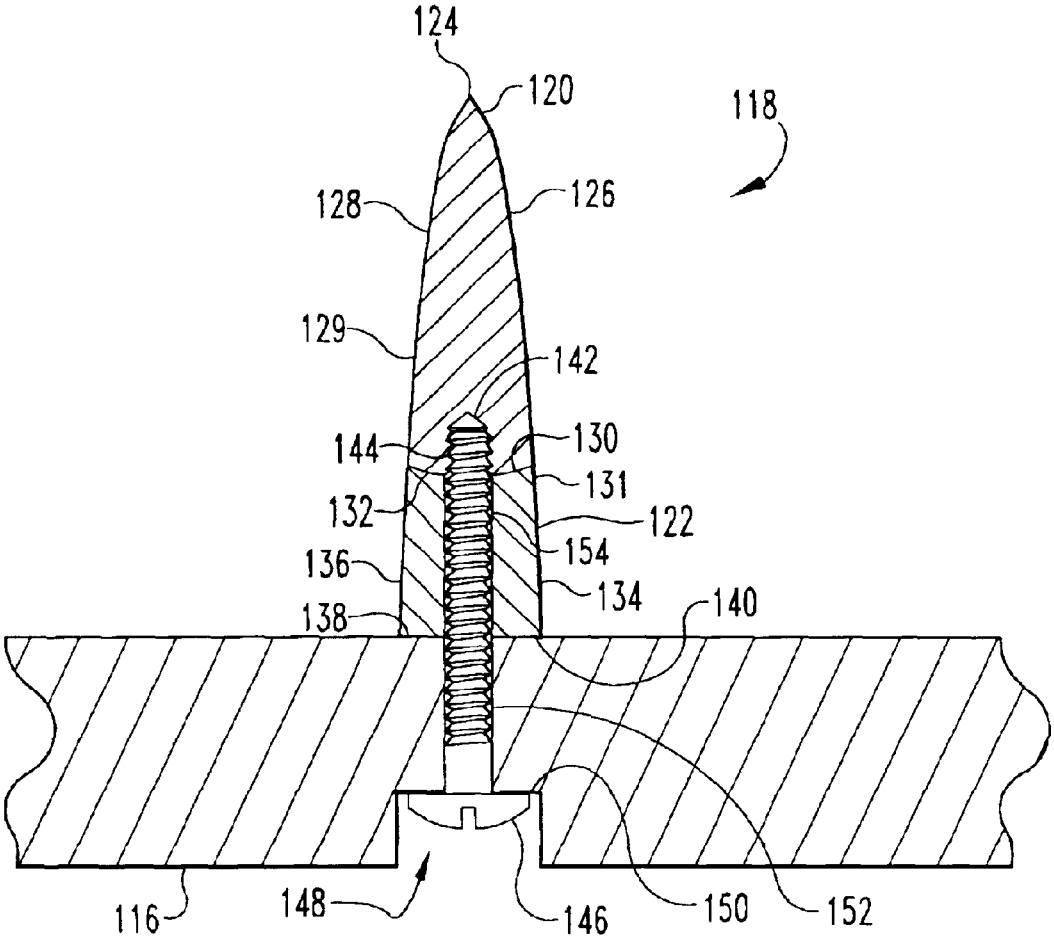
FIG. 8 is a partial cross-sectional view of the wake board and fin assembly shown in FIG. 7 taken along line 8—8.
Figure 9:
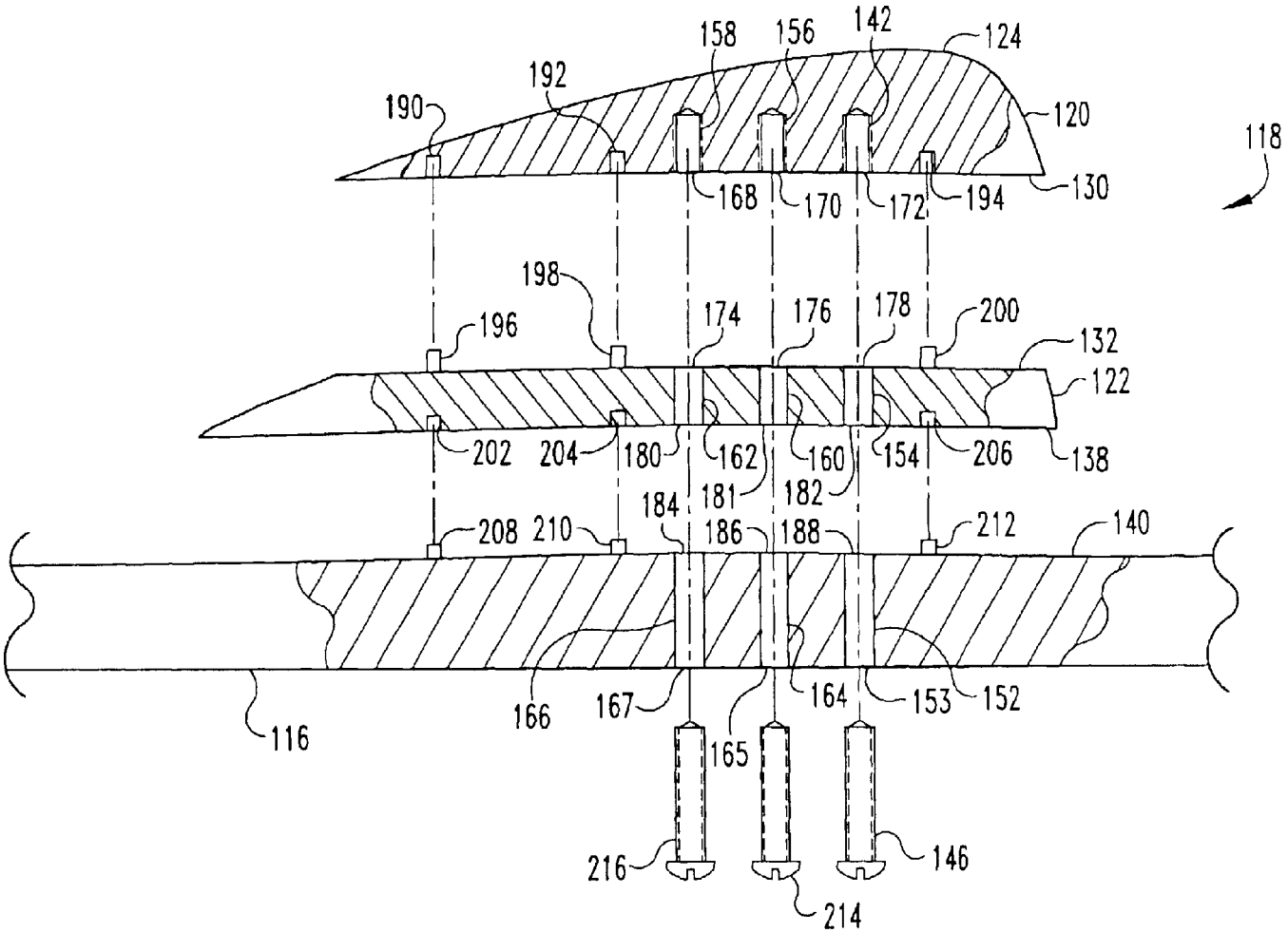
FIG. 9 is an exploded, partial cross-sectional view of the wake board and fin assembly shown in FIG. 7.

FIG. 8 is a partial cross-sectional view of fin assembly 118 and wakeboard 116 taken along line 8—8 and an exploded, partial cross section view of fin assembly 118 and wakeboard 116 is shown in FIG. 9. In this particular embodiment, fin cap 120 includes a tip portion 124, a mounting surface 130 and two opposed major surfaces 126 and 128 extending between tip 124 and mounting surface 130. Fin base 122 includes a first mounting surface 132, a second mounting surface 138 and two opposed major surfaces 134 and 136 extending between first mounting surface 132 and second mounting surface 138.

Continuing with the present example, fin cap 120 further includes at least one mounting socket 142, 158, 156. In this particular example, three mounting sockets 142, 158, 156 are shown for illustrative purposes. Each mounting socket 142, 158, 156 includes a mounting socket opening 168, 170, 172 in mounting surface 130 and a locking mechanism 144 (FIG. 8) corresponding to locking members 146, 214, 216 as will be described in greater detail below. Preferably, fin cap 120 further includes one or more guide pin sockets 190, 192, 194. In this particular example, fin cap 120 is shown with three guide pin sockets 190, 192, 194 although fin caps having more, fewer or no guide pin sockets are also contemplated.

Fin base 122 includes at least one mounting channel 154, 160, 162 passing therethrough. In this particular example, fin base 122 is shown with three mounting channels 154, 160, 162 although fin bases having more or fewer mounting channels are also contemplated. Preferably, fin base 122 has a mounting channel 154, 160, 162 corresponding to each mounting socket 142, 158, 156, respectively, of fin cap 120. Each mounting channel 154, 160, 162 includes a mounting channel opening 174, 176, 178 in first mounting surface 132 and a mounting channel opening 180, 181, 182 in second mounting surface 138. Preferably, fin base 122 further includes one or more guide pins 196, 198, 200 extending from first mounting surface 132. In this example, fin base 122 is shown with three guide pins 196, 198, 200 although fin bases having more, fewer or no guide pins are also contemplated. Preferably, fin base 122 has a guide pin 196, 198, 200 corresponding to each guide pin socket 190, 192, 194, respectively, on fin cap 120 and each guide pin 196, 198, 200 is sized and configured to fit securely in the corresponding guide pin socket 190, 192, 194. Fin base 122 also preferably further includes one or more guide pin sockets 202, 204, 206 in second mounting surface 138. In this particular example, fin base 122 is shown with three guide pin sockets 202, 204, 206 although fin bases having more, fewer or no guide pin sockets are also contemplated.

Wakeboard 116 may optionally include at least one mounting channel 152, 164, 166 passing therethrough, a fin assembly mounting surface 140 and at least one mounting slot 148. Each mounting channel 152, 164, 166 includes a mounting channel opening 184, 186, 188 in fin assembly mounting surface 140 and a mounting channel opening 153, 165, 167 in mounting slot 148. Preferably, at least one mounting slot 148 includes a slot base 150. Preferably, wakeboard 116 includes a mounting channel 152, 164, 166 corresponding to each mounting channel 154, 160, 162, respectively, in fin base 122. Preferably, wakeboard 116 further includes one or more guide pins 208, 210, 212 extending from fin assembly mounting surface 140. In this example, wakeboard 116 is shown with three guide pins 208, 210, 212 although wakeboards having more, fewer or no guide pins are also contemplated. Preferably, wakeboard 116 has a guide pin 208, 210, 212 corresponding to each guide pin socket 202, 204, 206, respectively, on fin base 122 second mounting surface 138 and each guide pin 208, 210, 212 is sized and configured to fit securely in the corresponding guide pin socket 202, 204, 206.

Three locking members 146, 214, 216 are shown in this particular example, although fin assemblies including more or fewer locking members are also contemplated. Preferably, fin assembly 118 includes one locking member 146, 214, 216 corresponding to each mounting socket 142, 156, 158, respectively of fin cap 120. Locking members 146, 214, 216 are shown in FIGS. 8 and 9 as screws for illustrative purposes only. Other suitable locking members such as bolts, bayonet-type fasteners snap-fit, dovetail slide, straight slide, top load and lock and the like are also contemplated for the fin cap, the fin base, or both. Preferably, mounting socket 142, 156, 158 includes a locking mechanism suitable for locking member 146, 214, 216. In this particular example, mounting sockets 142, 156, 158 further include threaded portions 144 (FIG. 9) sized and configured to allow locking members 146, 214, 216 to be threaded into locking engagement with mounting sockets 142, 156, 158. Also preferably, mounting channels 154, 160, 162 and 152, 164, 166 are sized and configured so as to allow at least a portion of locking members 146, 214, 216 to pass therethrough while slot base 150 is sized and configured so as to abut a portion of locking members 146, 214, 216 as shown in FIG. 8.

Surfaces 126 and 134 preferably form a continuous surface 131 when fin cap 120, fin base 122 and wakeboard 116 are engaged as seen in FIG. 8. Additionally, surfaces 128 and 136 preferably form a continuous surface 129 when fin cap 120, fin base 122 and wakeboard 116 are engaged. As seen in FIG. 8, continuous surfaces 129 and 131 give fin assembly fin assembly 118 a particular hydrodynamic profile. This profile affects the performance characteristics of fin assembly 118 when engaged with wake board 116. Alternate embodiments of fin assemblies (not shown) according to the present invention may have different profiles and/or performance characteristics than fin assembly 118.

Optionally, a user may replace one fin assembly with another fin assembly as desired to achieve different performance characteristics for a particular water sport board. For example, smaller, thinner fin assemblies generally work well in calmer water conditions while larger, wider fin assemblies provide increased stability in rough water. Alternatively, fin base 122 may be removed and a fin base (not shown) according to another embodiment of the present invention disposed between fin cap 120 and water sport board 116 thereby giving board 116 different performance characteristics.

Optionally, a removable cover or cap (not shown) covers mounting slot 148 when wakeboard 116 is in use and is removed when reconfiguring fin assembly 118 as is described in greater detail below. Optionally, fin base 122 is removed and fin cap 120 is mounted directly to wakeboard 116 using at least one of a second locking member 256, 258, 260 (FIG. 10) as will be described in greater detail further below.

Figure 11:
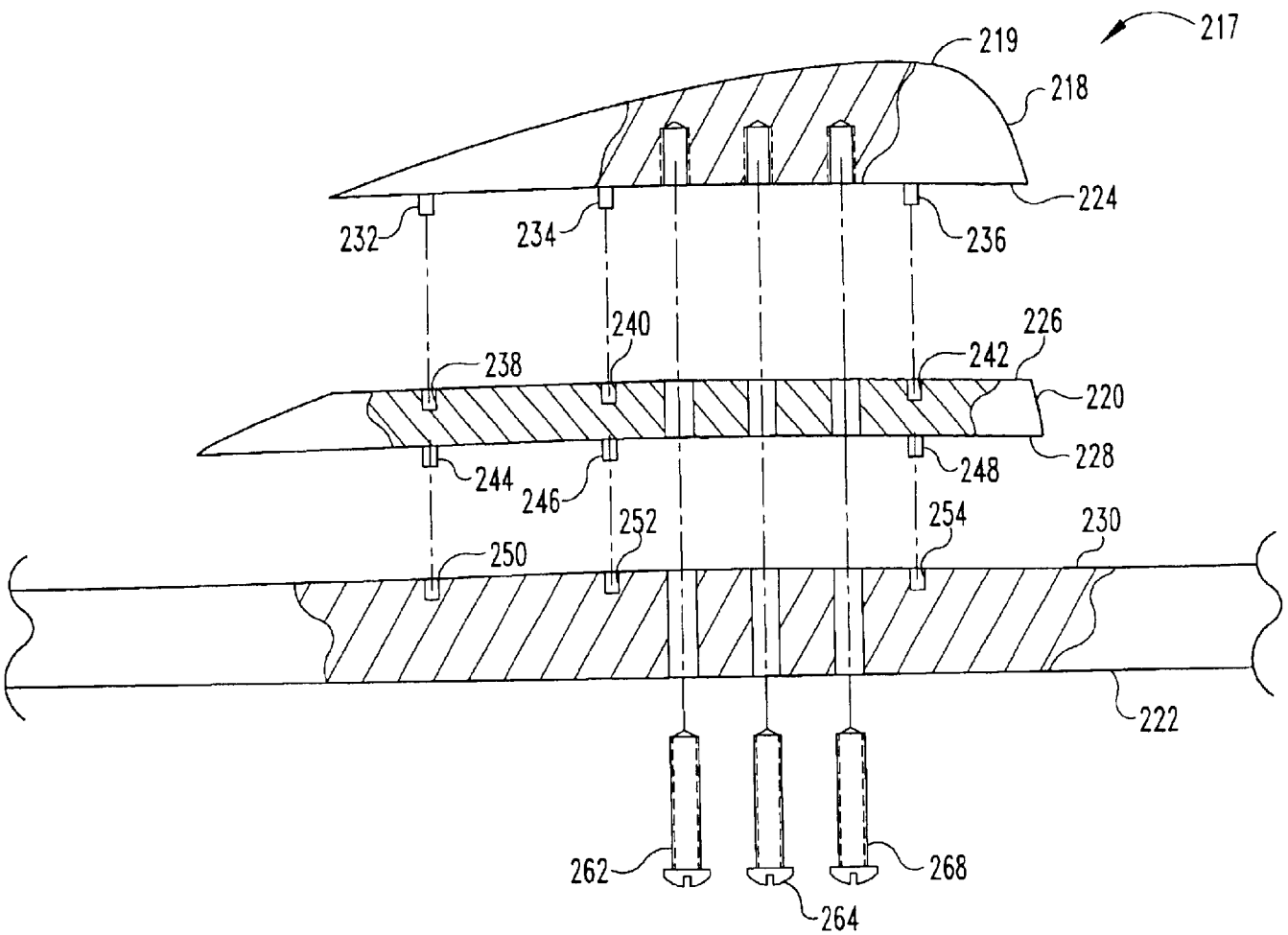
FIG. 11 is exploded, partial cross-sectional view of the wake board and fin assembly shown in FIG. 7 according to yet another embodiment of the present invention.

FIG. 11 shows an exploded, partial cross-sectional view of a fin assembly 217 and a wakeboard 222 according to an alternative embodiment of the present invention. Fin assembly 217 comprises a fin cap 218 having a tip portion 219 and a mounting surface 224, a fin base 220 having a first mounting surface 226 and a second mounting surface 228, and a least one locking member 262, 264, 268. Wakeboard 222 includes a fin assembly mounting surface 230. In this particular example, fin base 220 further includes at least one guide pin socket 238, 240, 242 in first mounting surface 226. Fin base 220 is shown with three guide pin sockets 238, 240, 242 in this example, although fin bases having more, fewer or no guide pin sockets are also contemplated. Fin cap 218 further includes at least one guide pin 232, 234, 236 extending from mounting surface. Fin cap 218 is shown with three guide pins 232, 234, 236 in this example, although fin caps having more, fewer or no guide pins are also contemplated. Preferably, fin cap 218 has a guide pin 232, 234, 236 corresponding to each guide pin socket 238, 240, 242, respectively, on fin base 220 and each guide pin 232, 234, 236 is sized and configured to fit securely in the corresponding guide pin socket 238, 240, 242.

Continuing with the present example, wakeboard 222 further includes at least one guide pin socket 250, 252, 254 in fin assembly mounting surface 230. Wakeboard 222 is shown with three guide pin sockets 250, 252, 254 in this example, although wakeboards having more, fewer or no guide pin sockets are also contemplated. Fin base 220 further includes at least one guide pin 244, 246, 248 extending from second mounting surface 228. Fin base 220 is shown with three guide pins 244, 246, 248 in this example, although fin bases having more, fewer or no guide pins are also contemplated. Preferably, fin base 220 has a guide pin 244, 246, 248 corresponding to each guide pin socket 250, 252, 254, respectively, on wakeboard 222 and each guide pin 244, 246, 248 is sized and configured to fit securely in the corresponding guide pin socket 250, 252, 254.

Figure 12:
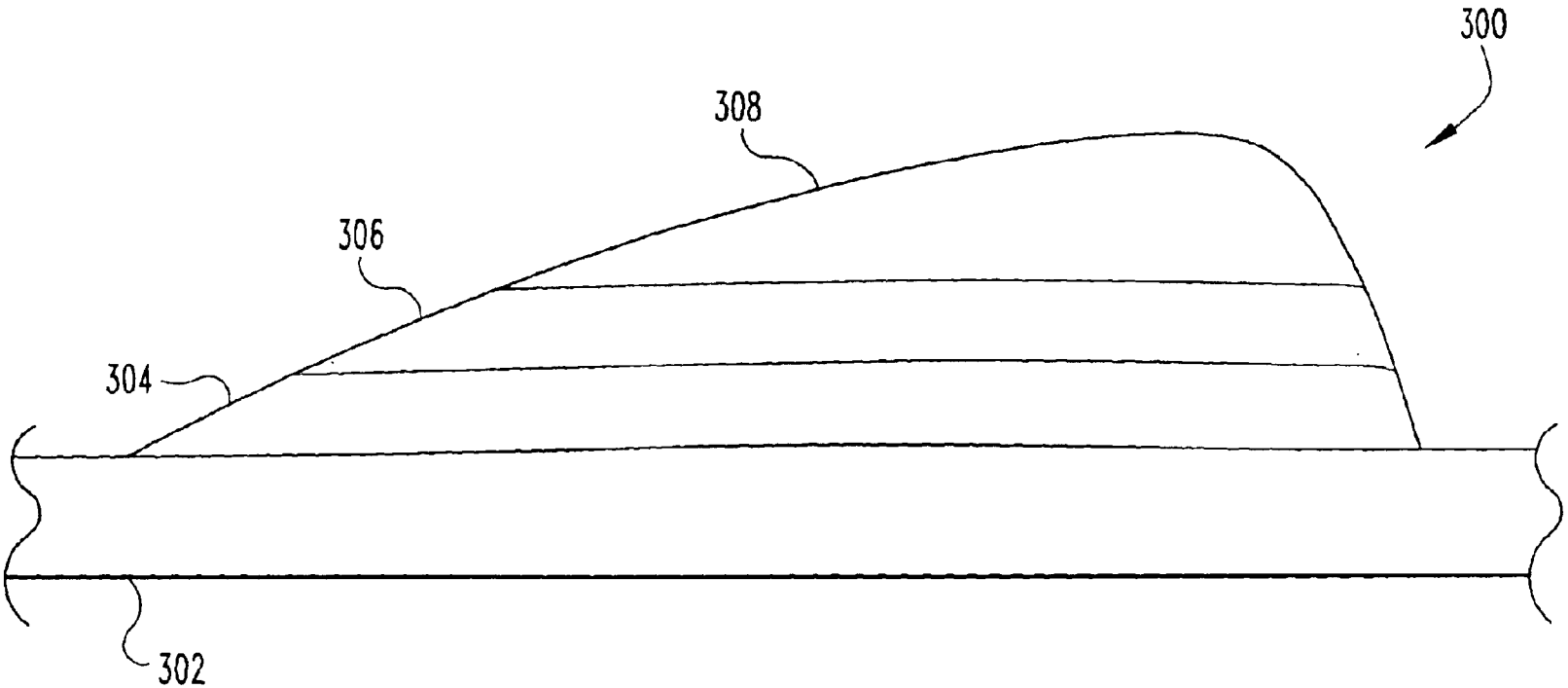
FIG. 12 is a detailed view of a wake board and fin assembly according to still another embodiment of the present invention.

FIG. 12 shows a fin assembly 300 according to still another embodiment of the present invention engaged to a watersport board 302. In this particular embodiment, fin assembly 300 comprises a fin cap 308, a first fin base 306 and a second fin base 304. Optionally, second fin base 304 can be removed and first fin base 306 and fin cap 308 engaged with water sport board 302 to decrease the depth of fin assembly 300 in the water when board 302 is used. Alternatively, fin assembly 300 may be removed from board 302 and replaced by a fin assembly according to another embodiment of the present invention having different hydrodynamic characteristics from fin assembly 300 as desired, for example, when water conditions change.

Figure 13:
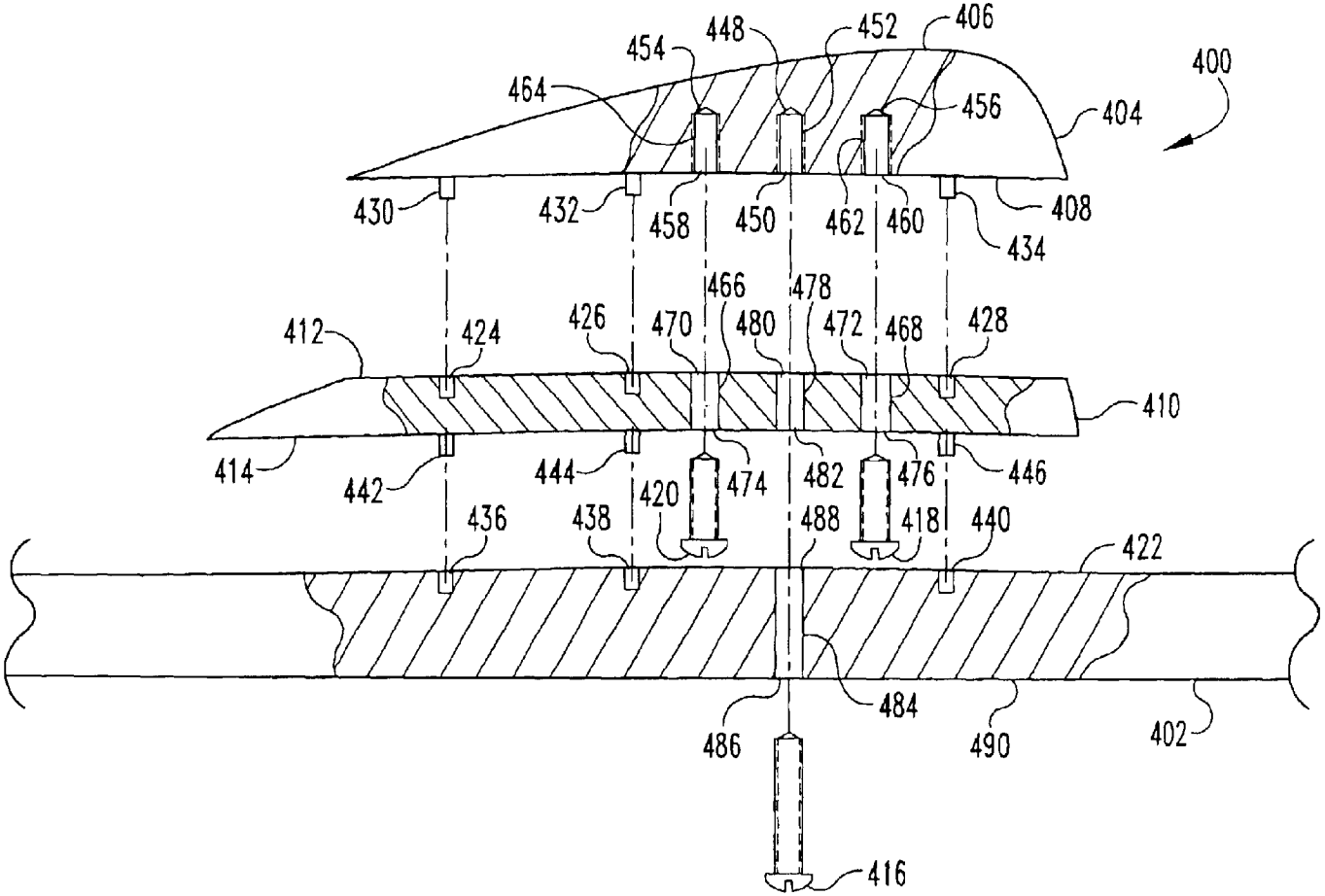
FIG. 13 is exploded, partial cross-sectional view of the wake board and fin assembly shown in FIG. 7 according to still another embodiment of the present invention.

FIG. 13 shows an exploded, partial cross-sectional view of a fin assembly 400 and a wakeboard 402 according to an alternative embodiment of the present invention. Fin assembly 400 comprises a fin cap 404 having a tip portion 406 and a mounting surface 408, a fin base 410 having a first mounting surface 412 and a second mounting surface 414, at least one board locking member 416, and at least one fin locking member 418, 420. Wakeboard 402 includes a fin assembly mounting surface 422. In this particular example, fin base 410 further includes at least one guide pin socket 424, 426, 428 in first mounting surface 412. Fin base 410 is shown with three guide pin sockets 424, 426, 428 in this example, although fin bases having more, fewer or no guide pin sockets are also contemplated. Fin cap 410 further includes at least one guide pin 430, 432, 434 extending from mounting surface 408. Fin cap 404 is shown with three guide pins 430, 432, 434 in this example, although fin caps having more, fewer or no guide pins are also contemplated. Preferably, fin cap 404 has a guide pin 430, 432, 434 corresponding to each guide pin socket 424, 426, 428, respectively, on fin base 410 and each guide pin 430, 432, 434 is sized and configured to fit securely in the corresponding guide pin socket 424, 426, 428.

Continuing with the present example, wakeboard 402 further includes at least one guide pin socket 436, 438, 440 in fin assembly mounting surface 422. Wakeboard 402 is shown with three guide pin sockets 436, 438, 440 in this example, although wakeboards having more, fewer or no guide pin sockets are also contemplated. Fin base 410 further includes at least one guide pin 442, 444, 446 extending from second mounting surface 414. Fin base 410 is shown with three guide pins 442, 444, 446 in this example, although fin bases having more, fewer or no guide pins are also contemplated. Preferably, fin base 410 has a guide pin 442, 444, 446 corresponding to each guide pin socket 436, 438, 440, respectively, on wakeboard 402 and each guide pin 442, 444, 446 is sized and configured to fit securely in the corresponding guide pin socket 436, 438, 440.

Continuing with the present example, fin cap 404 further includes at least one board mounting socket 448. In this particular example, one board mounting socket 448, is shown for illustrative purposes. Each board mounting socket 448 includes a mounting socket opening 450 in mounting surface 408 and a locking mechanism 452 corresponding to board locking member 416 as will be described in greater detail below. Fin cap 404 further includes at least one fin mounting socket 454, 456. Each fin mounting socket 454, 456 includes a mounting socket opening 458, 460 in mounting surface 408 and a locking mechanism 462, 464 corresponding to locking members 418, 420 as will be described in greater detail below.

Fin base 410 includes at least one fin mounting channel 466, 468 passing therethrough. In this particular example, fin base 410 is shown with two fin mounting channels 466, 468 although fin bases having more or fewer fin mounting channels are also contemplated. Preferably, fin base 410 has a fin mounting channel 466,468 corresponding to each fin mounting socket 454, 456, respectively, of fin cap 404. Each fin mounting channel 466, 468 includes a mounting channel opening 470, 472 in first mounting surface 412 and a mounting channel opening 474, 476 in second mounting surface 414. Fin base 410 further includes at least one board mounting channel 478. In this particular example, board mounting channel 478 includes a mounting channel opening 480 in first mounting surface 412 and a mounting channel opening 482 in second mounting surface 414. In other examples of the present invention, board mounting channel 478 includes a mounting channel opening in second mounting surface 414 and a closed end (not shown) at first mounting surface 412.

Wakeboard 402 may optionally include at least one assembly mounting channel 484 passing therethrough, a fin assembly mounting surface 422 and a top surface 490. Each mounting channel 484 includes a mounting channel opening 488 in fin assembly mounting surface 422 and a mounting channel opening 486 in top surface 490. Preferably, wakeboard 402 includes a mounting channel 484 corresponding to each board channel 478 in fin base 410.

Three locking members 416, 418, 420 are shown in this particular example, although fin assemblies including more or fewer locking members are also contemplated. Preferably, fin assembly 400 includes one board locking member 416 corresponding to each board mounting channel 484 of wakeboard 402. Also, fin assembly 400 preferably further includes one fin locking member 418, 420 corresponding to each fin mounting socket 466, 468 of fin base 410. In one embodiment of the present invention, fin locking members 418, 420 are sized and configured so at least a portion of locking members 418 420 pass through fin channel 472, 470, respectively, and are lockable in fin socket 456, 454, respectively, when fin cap 404 is engaged with fin base 410. Board locking member 416 is sized and configured so at least a portion of locking member 416 passes through board channel 484 and is lockable in base socket 478 when fin base 410 is engaged with wakeboard 402. Preferably, locking member 416 is sized and configured so that at least a portion of locking member 416 passes through board channel 484 and is lockable in board mounting socket 448 when fin cap 404 is mounted to wakeboard 402 without fin base 410.

Locking members 416, 418, 420 are shown as screws for illustrative purposes only. Other suitable locking members such as bolts, bayonet-type fasteners, snap-fit, dovetail slide, straight slide, top load and lock and the like are also contemplated for the fin cap, fin base, or both. Preferably, mounting sockets 454, 456 include a locking mechanism 464, 462, respectively, suitable for locking members 418, 420. Also, mounting channel 478 and mounting socket 448 include a locking mechanism suitable for locking member 416.

The use of fin assembly 118 as shown in FIG. 9 with a wakeboard will now be described. Typical wakeboards are from forty-eight (48) inches to sixty (60) inches in length and from thirteen (13) to seventeen (17) inches wide, however wakeboards having other dimensions may also be used. This is only on example of the use of a fin assembly according to one embodiment of the present invention with a watersport board. Fin assemblies according to other embodiments of the present invention used with other types of watersport boards follow similar procedures.

First, mounting socket openings 168, 170 and 172 are aligned with corresponding mounting channel openings 174, 176 and 178, respectively. Optionally, alignment is ensured by first engaging guide pins 196, 198 and 200 with guide pin sockets 190, 192 and 194, respectively, such as in the present example. Next, mounting channel openings 180, 181 and 182 are aligned with corresponding mounting channel openings 184, 186 and 188. Optionally, alignment is ensured by first engaging guide pins 208, 210 and 212 with guide pin sockets 202, 204 and 206, respectively, such as in the present example. Finally, fin assembly 118 is secured to wakeboard 116 by inserting locking members 146, 214, 216 through mounting channels 152, 164, 166 and 154, 160, 162 and into mounting sockets 142, 156, 158, respectively, and locking locking members 146, 214, 216 in mounting sockets 142, 156, 158, respectively. Optionally, a cover or cap (not shown) is placed over mounting slot 148 to prevent the user from contacting and potentially inadvertently unlocking locking members 146, 214, 216 during use of wakeboard 116.

Figure 10:
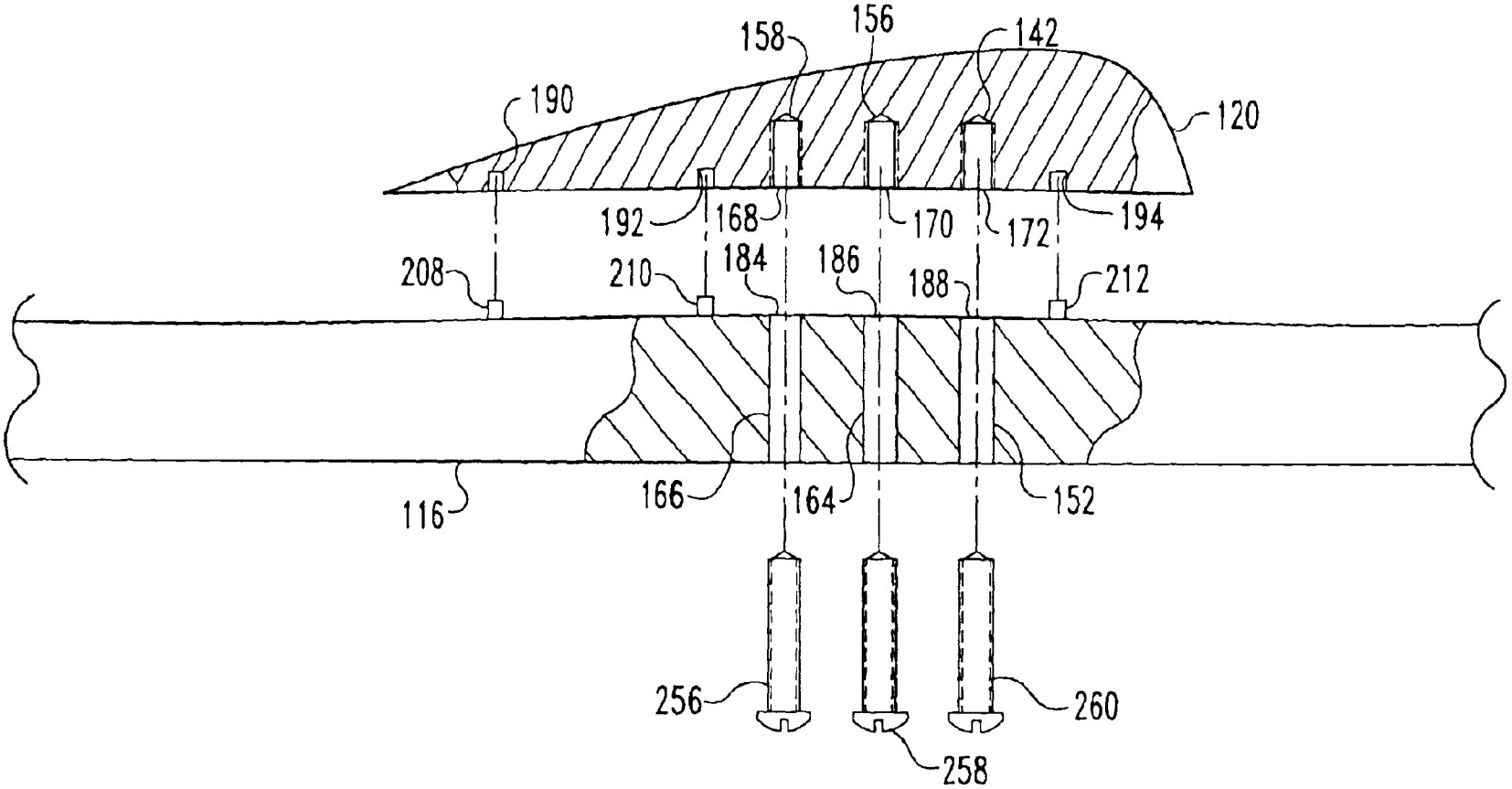
FIG. 10 is an exploded, partial cross-sectional view of the wake board and fin assembly shown in FIG. 7 according to another embodiment of the present invention.

To reconfigure fin assembly 118 and wakeboard 116 from the configuration shown in FIG. 9 to the configuration shown in FIG. 10, first the optional cover (if present) is removed from mounting slot 148 so locking members 146, 214, 216 are accessible. Locking members 146, 214, 216 are unlocked from mounting sockets 142, 156, 156, respectively, using a suitable tool and removed from mounting channels 152, 164, 166 and 154, 160, 162, respectively. Fin cap 120 is then disengaged from fin base 122 and fin base 122 is disengaged from wakeboard 116. Mounting socket openings 168, 170 and 172 are then aligned with corresponding mounting channel openings 184, 186 and 188, respectively. Optionally, alignment is ensured by first engaging guide pins 208, 210 and 212 with guide pin sockets 190, 192 and 194, respectively, such as in the present example. Finally, fin cap 120 is secured to wakeboard 116 by inserting second locking members 256, 258, 260 (FIG. 10) through mounting channels 152, 164, 166 and into mounting sockets 142, 156, 158, respectively, and locking second locking members 256, 258, 260 in mounting sockets 142, 156, 158, respectively. Optionally, a cover or cap (not shown) is replaced over mounting slot 148.

Fin assemblies according to the present invention as previously described allow watersport board users to transport a single board to a body of water and then configure and reconfigure fin assemblies as desired to suit current water conditions. Fin assemblies according to the present invention also allow board users to configure a single board to suit the skill levels of various users of differing abilities.

While the invention has been illustrated and described in detail in the drawings and foregoing description, the same is to be considered as illustrative and not restrictive in character, it being understood that only the preferred embodiment has been shown and described and that all changes, modifications and equivalents that come within the spirit of the inventions disclosed are desired to be protected. The articles "a", "an", "said" and "the" are not limited to a singular element, and include one or more such elements.

What is claimed is:

1. A watersport board fin assembly, comprising:

a removable fin cap;

a separate, removable first fin base, said first fin base being mountable between the watersport board and said fin cap to selectively extend the distance of said fin cap below said watersport board; and a separate, removable second fin base being mountable between the watersport board and said first fin base to selectively extend the distance of said fin cap below said watersport board.

2. The assembly of claim 1, further comprising at least one first locking member capable of releasably locking said fin can to said first fin base further comprising at least one second locking member capable of releasably locking said first fin base to said watersport board and of releasably locking said fin cap to said watersport board.

3. The assembly of claim 1, wherein:

said fin cap further comprises a first surface and a second, opposed surface;

said first fin base further comprises a first surface and a second, opposed surface; and wherein said fin cap first surface and said fin base first surface form a continuous surface when said first fin base is mounted between said watersport board and said second fin base, and said fin cap second surface and said fin base second surface form a continuous surface when said first fin base is mounted between said watersport board and said second fin base.

4. The assembly of claim 1, further comprising:

a watersport board having at least one mounting channel therethrough and at least one fin mounting surface including at least one mounting channel opening; and at least one locking member for releaseably locking the fin cap to the fin base and the fin base to the watersport board;

wherein said fin base further includes a first mounting surface, a second mounting surface, opposed major surfaces extending from the first mounting surface and the second mounting surface, and at least one mounting channel extending therethrough, the first mounting surface includes at least one mounting channel opening, the second mounting surface includes at least one mounting channel opening;

wherein said fin cap further includes at least one mounting socket disposed therein, a tip, a mounting surface including at least one mounting socket opening, and opposed major surfaces extending from the tip to the mounting surface.

5. The assembly of claim 4, wherein the fin cap further includes at least one guide pin socket and the first mounting surface of the fin base further includes at least one guide pin extending therefrom and corresponding with and complimentary to the at least one guide pin socket of the fin cap.

6. The assembly of claim 5, wherein the second mounting surface of the fin base further includes at least one guide pin socket and the fin mounting surface of the watersport board further includes at least one guide pin extending therefrom and corresponding with and complimentary to the at least one guide pin socket of the second mounting surface.

7. The assembly of claim 5, wherein the fin cap further includes at least one guide pin extending therefrom and the first mounting surface of the fin base further includes at least one guide pin socket corresponding with and complimentary to the at least one guide pin of the fin cap.

8. The assembly of claim 7, wherein the second mounting surface of the fin base further includes at least one guide pin extending therefrom and the fin mounting surface of the watersport board further includes at least one guide pin socket corresponding with and complimentary to the at least one guide pin of the second mounting surface.

9. A watersport board fin assembly kit comprising:

a removable fin cap;

a removable first fin base, mountable between the watersport board and said fin cap to selectively extend the distance of said fin cap below said watersport board; and a removable second fin base, mountable between the watersport board and said fin cap to selectively extend the distance of said fin cap below said watersport board.

10. The kit of claim 9, wherein said first fin base extends said fin cap below said watersport board a greater distance than said second fin base.

11. The kit of claim 9, wherein said first fin base has a hydrodynamic profile and said second fin base has a hydrodynamic profile different from the profile of said first fin base.

12. The kit of claim 9, further comprising at least one first locking member for selectively locking said fin cap and said first fin base to said watersport board and at least one second locking member for selectively locking said fin cap and said second fin base to said watersport board.

13. The kit of claim 12 wherein said at least one first locking member and at least one second locking member are screws.

14. The kit of claim 12 wherein said at least one first locking member and at least one second locking member are bolts.

15. The kit of claim 12 wherein said at least one first locking member and at least one second locking member are bayonet-type fasteners.

16. The kit of claim 9, further comprising a watersport board.

17. The kit of claim 16, wherein said watersport board is a wakeboard having an overall length of between forty-eight (48) and sixty (60) inches.

18. The kit of claim 9, further comprising at least one first locking member for selectively locking said fin cap to said first fin base and at least one second locking member for selectively locking said first fin base to said watersport board and selectively locking said fin cap to said watersport board.

19. A method for configuring the fin of a watersport board, said method comprising:

providing a watersport board including at least one mounting channel therethrough and at least one fin mounting surface including at least one mounting channel opening;

providing a fin assembly including a fin base and a fin cap, wherein the fin base includes at least one mounting channel therethrough, a first mounting surface having at least one mounting channel opening, and a second mounting surface having at least one mounting channel opening, and wherein the fin cap includes at least one mounting socket and a mounting surface having at least one mounting socket opening;

providing at least one first locking member;

aligning the at least one mounting channel opening of the first mounting surface of the fin base with the at least one mounting socket opening of the fin cap;

aligning the at least one mounting channel opening of the watersport board with the at least one mounting channel opening of the second mounting surface of the fin base;

inserting the at least one first locking member through the at least one mounting channel of the watersport board and the at least one mounting channel of the fin base and into the at least one mounting socket of the fin cap; and locking the at least one first locking member so that the fin cap is secured to the fin base and the fin base is secured to the watersport board.

20. The method of claim 19 further comprising:

providing at least one second locking member wherein the at least one second locking member is shorter than the at least one first locking member;

unlocking the at least one first locking member so that the fin cap is unsecured from the fin base and the fin base is unsecured from the watersport board;

removing the at least one first locking member from the at least one mounting socket of the fin cap, the at least one mounting channel of the fin base and the at least one mounting channel of the watersport board;

removing the fin base;

aligning the at least one mounting channel opening of the watersport board with the at least one mounting socket opening of the fin cap;

inserting the at least one second locking member through the at least one mounting channel of the watersport board and into the at least one mounting socket of the fin cap; and locking the at least one second locking member so that the fin cap is secured to the watersport board.

* * * * *